United States Patent [19]

James et al.

[11] 4,274,267

[45] Jun. 23, 1981

[54] HORIZONTAL MERCHANDISING COOLER

[75] Inventors: David H. James; Manuel F. Junco, both of Spartanburg, S.C.

[73] Assignee: Tannetics, Inc., Erie, Pa.

[21] Appl. No.: 71,303

[22] Filed: Aug. 30, 1979

[51] Int. Cl.[3] ..... A47F 3/04; F25D 11/02

[52] U.S. Cl. ..... 62/252; 62/441; 312/45; 312/214; D6/187

[58] Field of Search ..... 312/214, 45, 72, 111, 312/304; 62/246, 252, 253, 441, 248, 249, 255, 258, 125, 127; 221/155, 3; D6/187, 189

[56] References Cited

U.S. PATENT DOCUMENTS

| | | | |
|---|---|---|---|
| 1,348,461 | 8/1920 | Washington | 62/258 X |
| 2,381,598 | 8/1945 | Jones | 62/441 |
| 2,476,491 | 7/1949 | Henderson | 62/251 X |
| 2,495,327 | 1/1950 | Hardin | 62/246 |
| 2,671,001 | 3/1954 | Ossanna, Jr. | 62/255 X |
| 2,671,319 | 3/1954 | Bortz | 62/252 |
| 2,793,925 | 5/1957 | Rosen | 62/252 X |
| 2,888,811 | 6/1959 | Hargrave | 62/255 |
| 3,204,421 | 9/1965 | Jirel | 62/252 X |
| 3,552,138 | 6/1971 | Davis | 62/252 X |

*Primary Examiner*—Lloyd L. King
*Attorney, Agent, or Firm*—Bailey, Dority & Flint

[57] ABSTRACT

A refrigerated horizontal drink box for merchandising soft drinks and the like is disclosed as including movable transparent doors covering individual compartments and brand name indicia carried closely beneath the transparent door disposed at such an angle to the door and to drink containers stacked horizontally in the compartment that positive brand name identification may be had without opening the door whereby advantageous advertisement positioning of the product is achieved and unnecessary opening of the door is avoided.

5 Claims, 2 Drawing Figures

Fig. 1.
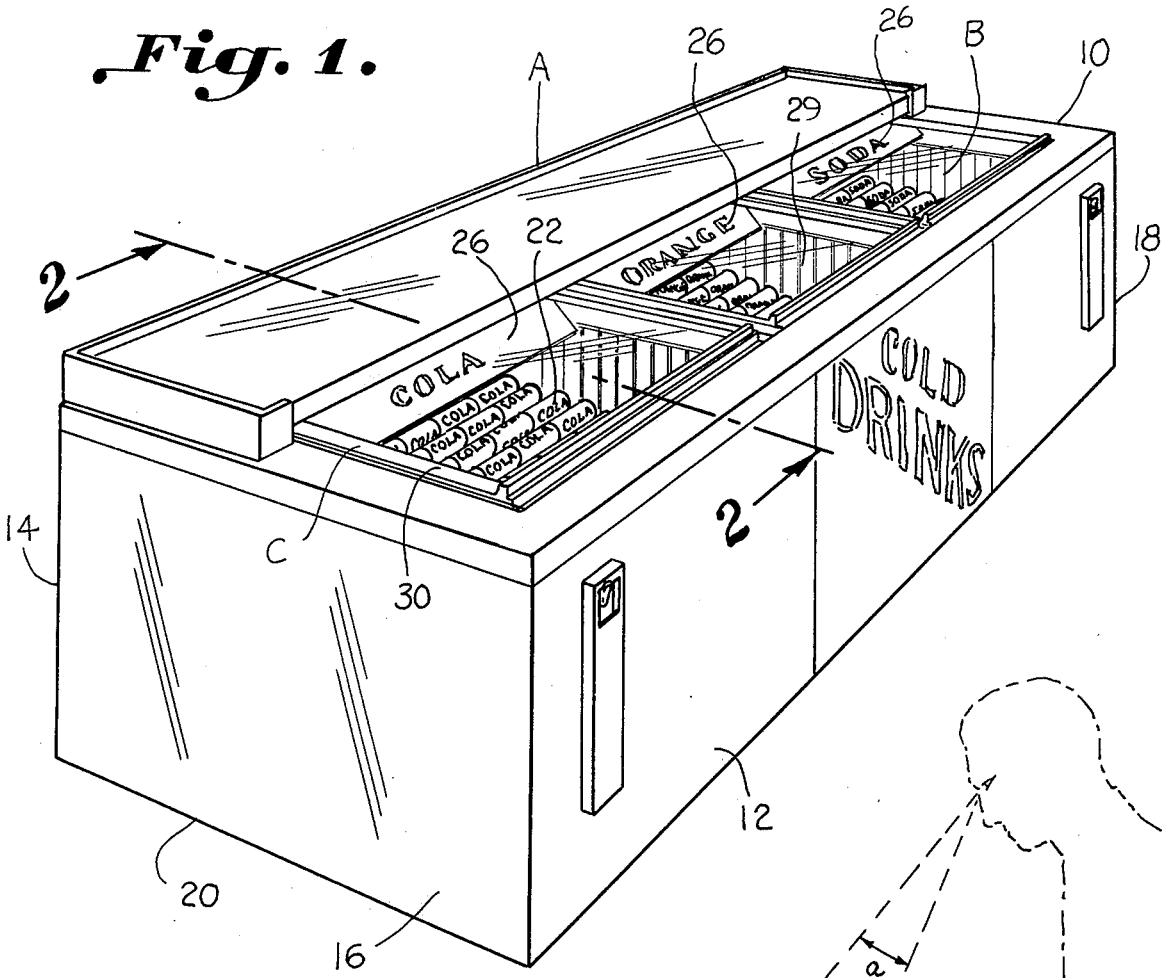
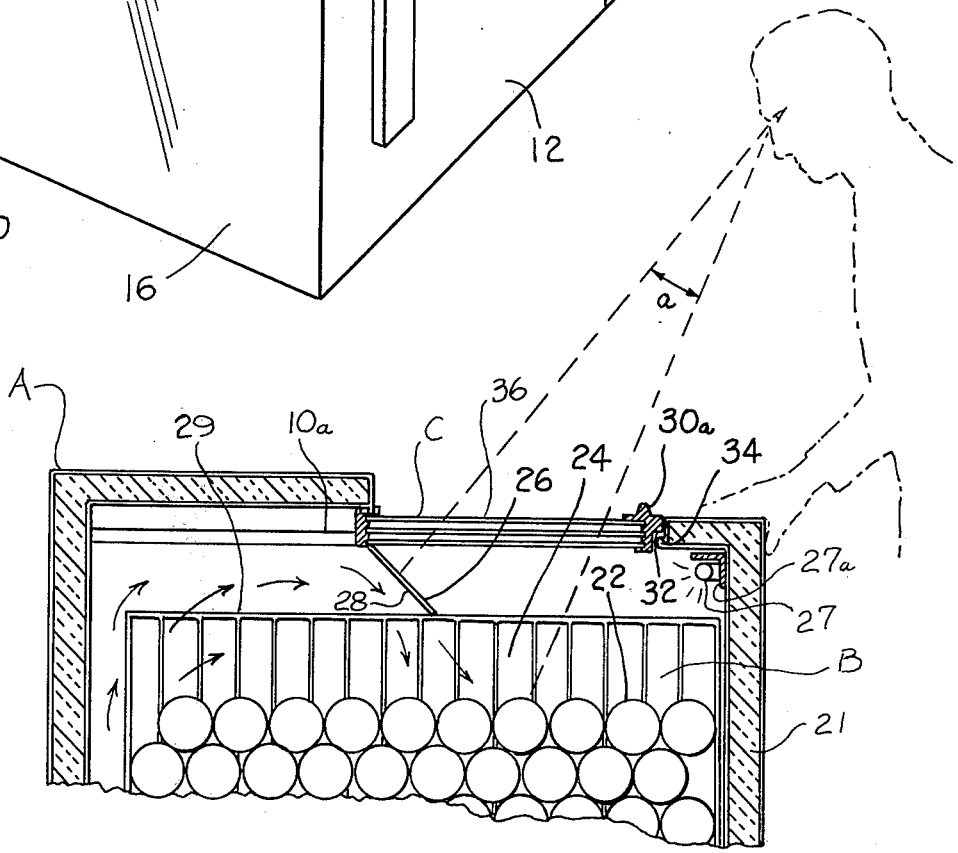
Fig. 2.

HORIZONTAL MERCHANDISING COOLER

BACKGROUND OF THE INVENTION

The merchandising of soft drinks and like articles from refrigerated horizontal boxes is troublesome in terms of providing attractive product advertisement and positioning which affects the salability of the drink. Positive product identification and selection has been a problem due to insufficient illumination and visibility resulting from the horizontal configuration and construction of such a merchandising box.

Horizontal soft drink coolers have typically included solid opaque sliding doors requiring that they be opened in order to identify the brand of drink below the door. Often a consumer will open every door before locating a desired drink. This unnecessary opening of doors results in premature wearing of the sliding door frame structure and seals and a considerable loss and waste of energy. Frost and condensation often make identification troublesome on glass doors. Printing of the brand name or other identification on the door closure does not produce a beneficial advertising and merchandising effect since the product is obscured.

SUMMARY OF THE INVENTION

It has been found that highly attractive and effective merchandising of soft drinks and like articles from horizontal refrigerator boxes may be had by utilizing a plurality of separated compartments each accommodating a single brand of drink and a transparent door closure overlying each compartment wherein corresponding brand name indicia is carried beneath the transparent closure in such size and angular relation as to afford positive and simultaneous identification with the brand name appearing on the drink containers stacked horizontally. Artificial fluorescent illumination affords a bright, clean appearance to each compartment and brand name indicia displayed therein enhancing the advertisement positioning of the product.

Accordingly, an important object of the present invention is the creation of attractive and effective product merchandising from a refrigerated horizontal receptacle.

Another important object of the present invention is to provide increased illumination and enhanced advertisement positioning of articles within a horizontal refrigerated drink box which allows positive identification and selection by the consumer of a particular brand name of product from the cooler without having to open the door thereof.

Yet another important object of the present invention is to provide a refrigerated drink box for merchandising several brand names of drinks having a plurality of individual compartments covered by overlying individual transparent door closures and brand name indicia carried beneath the transparent closure corresponding to the brand name printed on the drink packages therein for positive and simultaneous identification.

Yet another important object of the present invention is to provide a refrigerated drink box which is highly energy efficient which eliminates unnecessary and unintended opening of the door.

Yet another important object of the present invention is to control the allocation of different brand names of drinks in a refrigerated drink box by allocating the different brands in separate compartments having transparent closure doors through which the brand name may be readily perceived.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view of a refrigerated drink box for displaying and merchandising articles according to the present invention; and FIG. 2 is a partial section view taken along the line 2—2 of FIG. 1.

DESCRIPTION OF A PREFERRED EMBODIMENT

The drawing illustrates a refrigerated drink box A for merchandising drink packaging containers of several brands and the like which includes an elongated horizontal open top receptacle 10 having elongated spaced front and back walls 12 and 14, integral spaced end walls 16 and 18, and integral bottom floor 20, all of which contain insulation 21 and define an interior space in said receptacle. A plurality of compartment areas B are defined within the interior space of the receptacle 10 which accommodates horizontal placement of the drink packaging containers 22 in a stacked configuration so that the brand name printed on the drink packaging containers, particularly on the top layer of stacked containers, is readily ascertainable and visible.

A plurality of transparent door closure members C are carried overlying respective compartment areas affording illumination thereto and permitting visual inspection of the interior of the compartment areas. The transparent doors are manually openable and closable for access to the compartment. One each of the transparent doors C overlies a respective one of the compartment areas B.

Brand names indicia indicated 26, underneath each of the transparent doors C in each compartment area, is enlarged and corresponds to the brand name on the drink packaging containers stacked therein. Identifying brand name indicia 26, together with corresponding drinks directly therebelow, further define at least one individual compartment beneath each transparent door closure in which a single brand name is merchandized from compartment area B. The brand name indicia is carried by the receptacle 10 such that it remains stationary when the door is moved. The brand name indicia is carried in a manner that it depends downwardly beneath the transparent door B adjacent thereto and is disposed at an angle relative to the horizontally stacked drink packaging containers in a respective compartment and simultaneously visible to a person approaching the drink box so as to enable identification of the brand name of the drink therein before the door would be opened. Thus, it results that the product brand name is attractively and simultaneously displayed in close juxtaposed proximity to the drink packages and brand name appearing thereon greatly enhancing positive identification and advertisement positioning of the drink packages resulting in increased salability while positively identifying the drink packages to a consumer reducing the unnecessary and unintended opening of the door closures.

Increased illumination is provided by fluorescent lighting 27 carried by a longitudinal "L" shaped bracket 27*a* affixed along the inside length of front wall 12 which has been found to provide a bright, yet soothing, and clean appearance to the product and brand name indicia displayed therein even in the dim areas of a store.

It is important that the brand name indicia 26 be carried by the receptacle in a plane inclined to the horizontal plane of the stacked containers 22 and to the transparent closure C so that brand name indicia 26 and the brand name on the drink containers are within the visual angle, a, of one approaching the drink box and, hence, simultaneously perceivable enabling positive identification upon reaching a point at which the transparent door would normally be opened. In this manner, any initial reaction to open the closure member to identify the drink is avoided since the drink is positively identified and illuminated. A reduction in the number of unnecessary or unintended openings of the door results and, hence, a savings and conservation of energy. Most important, however, is the merchandising effect upon a consumer who approaches the drink box and perceives the brand name indicia simultaneously with the brand names printed on the containers when illuminated by pleasant fluorescent lighting.

Brand name indicia 26 may be carried or affixed on air deflection plate 28 used on some types of horizontal coolers, or other suitable display plate means carried by the receptacle 10, such as affixed to the sliding frame structure 10*a*, may be utilized affixed in the proper inclination and position as disclosed herein.

The compartment areas B may be further defined by frame partitions 29 separating the adjacent stacks of drink containers.

As illustrated, the transparent door member C includes a frame 30 which includes a forward flange member 30*a* which functions as a handle and also includes a sealing flange lip 32 which engages a mating flange 34 on the front wall of the drink box receptacle in an air sealing manner. Three panels 36 of spaced glass are utilized for insulation.

While a preferred embodiment of the invention has been described using specific terms, such description is for illustrative purposes only, and it is to be understood that changes and variations may be made without departing from the spirit or scope of the following claims.

What is claimed is:

1. A refrigerated drink box for merchandising drink packaging containers of several brands and the like comprising:

an elongated horizontal open top receptacle including elongated spaced front and back sidewalls, integral spaced end walls, and an integral bottom floor defining an interior space in said receptacle;

a plurality of compartment areas within said interior space accommodating placement of said drink packaging containers in a manner making the brand names on said drink packaging containers readily ascertainable and visible;

a plurality of transparent door closure members overlying respective compartment areas affording illumination and permitting visual inspection of the interior of said compartment areas and being manually openable and closable for access to said compartment areas, one each of said transparent closure members overlying a respective one of said compartment areas;

brand name indicia disposed beneath each said transparent door closure member enlarged and corresponding to a single brand name of drink displayed and contained directly therebelow to define an individual compartment within said compartment area from which said single brand name of drink is merchandized;

said brand name indicia being carried by said receptacle depending downwardly beneath said transparent door closure adjacent thereto and disposed at an angle relative to said door closure and drink packaging containers in a respective compartment so as to be simultaneously visible to a person upon approaching the drink box;

whereby the brand name is attractively and simultaneously displayed in close juxtaposed proximity to said drink packaging containers and brand name appearing thereon enhancing the merchandising thereof and enabling positive identification of said drink by brand name avoiding unnecessary and unintended opening of said door enclosures.

2. The apparatus of claim 1 wherein said drink packaging containers are stacked horizontally in each said compartment so that the brand names on the top layer of drink packaging containers are displayed in a readily visible manner.

3. The apparatus of claim 2 wherein said brand name indicia is carried by said receptacle in a plane inclined to the horizontal plane of said stacked drink containers so that said brand name indicia and brand name on said drink containers are within the visual angle of the eye of one approaching said drink box and, hence, simultaneously perceivable enabling positive identification upon reaching a point at which said transparent door would be manually opened.

4. The apparatus of claim 1 wherein said compartment areas are further defined by partitions separating adjacent stacks of said drink containers.

5. The apparatus of claim 1 including artificial illumination means carried inside said receptacle enhancing the merchandising and identification of said brand name indicia and brand name on said drink packaging containers.

* * * * *